US007343359B2

(12) United States Patent
Fearis et al.

(10) Patent No.: US 7,343,359 B2
(45) Date of Patent: Mar. 11, 2008

(54) FRANKING MACHINE HAVING A RETROFITTABLE WEIGHING DEVICE

(75) Inventors: Paul James Fearis, Cambridge (GB); Iain James Sabberton, Lymm Cheshire (GB); Peter David Cauwood, Waterbeach Cambridge (GB)

(73) Assignee: Francotyp - Postalia GmbH, Birkenwerder (DE)

( * ) Notice: Subject to any disclaimer, the term of this patent is extended or adjusted under 35 U.S.C. 154(b) by 1039 days.

(21) Appl. No.: 10/103,355

(22) Filed: Mar. 21, 2002

(65) Prior Publication Data

US 2002/0138453 A1 Sep. 26, 2002

(30) Foreign Application Priority Data

Mar. 21, 2001 (DE) ..... 101 14 529

(51) Int. Cl.
*G07B 17/02* (2006.01)

(52) U.S. Cl. ..... 705/407; 177/25.15

(58) Field of Classification Search ..... 705/400–410
See application file for complete search history.

(56) References Cited

U.S. PATENT DOCUMENTS

| | | | | |
|---|---|---|---|---|
| 4,366,552 A | | 12/1982 | Uchimura et al. | |
| 4,742,878 A | * | 5/1988 | Freeman et al. | 177/25.15 |
| 4,787,046 A | * | 11/1988 | Feinland et al. | 705/407 |
| 5,172,631 A | | 12/1992 | Manna | |
| 5,256,835 A | | 10/1993 | Rydzak | |
| 5,264,986 A | * | 11/1993 | Ohgami et al. | 361/685 |
| 5,379,923 A | * | 1/1995 | Sagastegui et al. | 222/181.2 |
| 5,538,234 A | * | 7/1996 | Yankloski | 271/11 |
| 5,605,467 A | * | 2/1997 | Beck et al. | 439/148 |
| 5,767,452 A | * | 6/1998 | Yankloski | 177/25.11 |
| 6,376,783 B1 | * | 4/2002 | Vaghi | 177/25.15 |

FOREIGN PATENT DOCUMENTS

| | | |
|---|---|---|
| EP | 0 525 368 B1 | 2/1993 |
| EP | 0 405 358 B1 | 5/1993 |
| EP | 0 405 357 B1 | 11/1994 |
| EP | 0 926 642 A2 * | 6/1999 |
| WO | WO 00/39576 | 7/2000 |
| WO | WO 00/39756 | 7/2000 |

OTHER PUBLICATIONS

Business Editors/High-Tech Writers Association of School Business Officials International Meeting and Exhibits, "Neopost Is Delivering Value Through Advanced Solutions at the ASBO International Meeting and Exhibits," Business Wire, New York, Oct. 2, 2000, p. 1.*

* cited by examiner

*Primary Examiner*—John W. Hayes
*Assistant Examiner*—Nathan H. Erb
(74) *Attorney, Agent, or Firm*—Laurence A. Greenberg; Werner H. Stemer; Ralph E. Locher

(57) ABSTRACT

A franking machine has a housing with at least a first housing part which is configured such that a retrofittable weighing unit can be fitted therein. The first housing part defines a recess in the housing. The recess is configured such that the weighing unit can be inserted. Fastening devices are provided at the recess for fastening a second housing part which closes the recess.

11 Claims, 5 Drawing Sheets

FRANKING MACHINE HAVING A RETROFITTABLE WEIGHING DEVICE

BACKGROUND OF THE INVENTION

Field of the Invention

The invention relates to a franking machine having a housing including at least a first housing part which is configured such that a retrofittable weighing unit can be fitted therein.

Conventional franking machines may be subdivided roughly into two groups depending on the volume of mail which is to be processed. The franking machines which are configured for a relatively large amount of mail are usually equipped with a transporting mechanism for the letter which is to be processed. In contrast, in the case of franking machines for a relatively small amount of mail, for example in the range of less than 20 to 30 letters per day, the letter usually has to be introduced and removed manually.

Weighing scales are usually provided for both types. These serve for determining the w eight of the letter or package which is to be franked, since the necessary postage value is usually determined accordingly. It is usually the case that the postage value which is to be printed is determined automatically by the franking machine using the measurement data supplied by the weighing scales.

While the franking machines for a relatively large volume of mail usually already include as standard inaccessible weighing scales, which are installed in the housing and are intended for weighing the letters, the franking machines for a small volume of mail are usually additionally equipped with separate weighing scales, which are connected to the franking machine via a cable or the like and can be set up alongside the franking machine.

Mainly in relatively small offices or small businesses, for which the latter type of franking machine is intended, there is often also a problem with space. The weighing scales, which additionally have to be set up alongside the franking machine, does usually pose something of a problem.

In order to solve this space-related problem, U.S. Pat. No. 4,787,046 proposes the installation of the franking machine on the weighing scales. If the weight of a letter is to be determined, this letter is positioned in the franking machine. The weighing scales then determine the weight by simply subtracting the weight of the franking machine from the measured value.

This configuration, however, first of all has the disadvantage that it produces a very large-volume object, which, not least from an esthetic point of view, is not particularly desirable. Secondly, in view of the considerable weight of the franking machine, the weighing scales have to be of relatively robust design. In addition, considerable outlay is required for the configuration of the weighing scales and of the measuring method since, on account of the high masses, the entire system is relatively susceptible to high oscillation amplitudes.

A further attempt to solve the problem of constricted space conditions is known from European Patent No. EP 0 405 358 B1, in the case of which weighing scales with a vertical letter slot are flanged on the rear side of the franking machine. Due to the vertically aligned letter slot into which the letters which are to be weighed have to be introduced, the franking machine with the weighing scales, while indeed having a somewhat smaller base surface area, nevertheless has a relatively large height. In addition, it is only possible for these weighing scales to process letters up to a certain thickness. Relatively large items of mail cannot be weighed thereby. Their weight has to be determined, if appropriate, on separate weighing scales. However, the larger the letter slot, in order for it to be possible to process the largest possible number of different thicknesses of items of mail, the further does the entire franking machine with weighing scales jut out.

SUMMARY OF THE INVENTION

It is accordingly an object of the invention to provide a franking machine which overcomes the above-mentioned disadvantages of the heretofore-known franking machines of this general type and which can easily be retrofitted with a weighing unit and which ensures the smallest possible configuration.

With the foregoing and other objects in view there is provided, in accordance with the invention, a franking machine, including:

a housing including at least a first housing part;

the housing part having a recess formed therein, the recess being configured such that a retrofittable weighing unit can be inserted therein; and first fastening devices disposed at the recess and configured such that a second housing part can be fastened for closing the recess.

The invention is based on the technical teaching that a small franking machine with a weighing unit which can be retrofitted straightforwardly is obtained if the first housing part defines a recess in the housing, the recess being configured for the insertion of the weighing unit, and provided in the region of the cutout are first fastening devices which are configured for fastening a second housing part, which closes the recess.

It has been found that it is possible for the first housing part, as a result of an appropriate configuration of the internals of the franking machine, to be configured such that it has a recess into which a retrofittable weighing unit can be inserted without this resulting in the volume of the franking machine increasing significantly. The configuration as a recess of the first housing part ensures that the first housing part or the housing of the franking machine can remain closed in order to ensure that any possible safety requirements in respect of the interior of the franking machine being closed off are satisfied.

The first fastening devices advantageously make it possible to install a second housing part, which closes and/or covers the recess, with the result that the visual impression given by the franking machine is not adversely affected by the recess with the fastening devices even when there is no weighing unit installed.

The recess can be adapted to any desired type of weighing unit. It is thus possible, for example, for it to be adapted to a weighing unit in the case of which the mail, that is to say for example the letter, is weighed in a standing position. In the case of such a weighing unit, a correspondingly configured securing device or holder is then provided, as a mail support, for this purpose. Such a weighing unit is then usually integrated in one of the essentially vertically extending side walls of the franking machine.

In the case of variants which are preferred because they are straightforward configurations and are thus straightforward to produce, the recess is configured for accommodating a weighing unit provided with an essentially horizontally extending mail support. A configuration which is particularly straightforward not just from a production point of view, but also in respect of ergonomic operation, is produced here if the recess is provided on the top side of the housing. The mail which is to be weighed may then simply be positioned on the weighing unit provided on the top side of the franking-machine housing.

In the case of particularly advantageous variants of the franking machine according to the invention, it is provided that the first fastening devices are configured for fastening the weighing unit. This functional integration results in a further reduction in the outlay for producing the franking machine.

The first fastening devices may be provided on a specific carrier or the like which is fastened in the interior of the franking machine, in order to achieve a sufficiently stable base for the weighing unit. This stable base is necessary for good measurement results in particular in the case of changing climatic conditions, particularly in the case of temperature fluctuations. In such a case, the fastening devices may then project, for example, through one or more corresponding cutouts in the housing of the franking machine.

The first fastening devices are preferably provided on the first housing part, as a result of which the production is simplified further. All that need be ensured here is that the first housing part is of sufficiently stiff configuration at least in the region of the recess, in order to make available a sufficiently strong and deformation-free base for the weighing unit. A particularly straightforward configuration is achieved here if the first fastening devices are integrally formed directly on the first housing part or are formed therein.

The first fastening devices may be configured in any desired manner. They may be configured for a form-fitting connection, a force-fitting connection, or a form-fitting and force-fitting connection. For example, they may be a constituent part of a screw-connection. On account of the straightforward and quick installation, it is preferably provided that the first fastening devices are configured for achieving a plug-in connection and, in addition or alternatively, for achieving a snap-in connection, while interacting with corresponding counterparts on the component which is to be fastened.

It is possible here for the first fastening devices to define a corresponding cutout or recess on or in the first housing part, into which a corresponding counterpart can then be plugged. It is also possible for the counterpart or the first fastening devices to be respectively equipped with correspondingly resiliently configured protrusions or undercuts assigned to the protrusions, these allowing a mutual latching-in operation and thus the formation of a snap-in connection.

The first fastening devices preferably include at least one pin-like fastening element. This can easily be integrally formed on the first housing part. They additionally have the advantage in particular in the case of the required closed-off state of the housing, in contrast to corresponding cutouts in the first housing part, that, in the case of a sufficiently long active length, they do not project into the housing interior and, accordingly, allow a relatively large clearance in the housing interior.

In the case of favorable variants of the franking machine according to the invention, there is provided a second housing part, which closes the recess and is fastened releasably on the first housing part via the first fastening devices. In respect of straightforward production with the smallest possible number of different parts, it is preferably provided here that the second housing part, or at least part of the second housing part, is configured for forming the mail support of the weighing unit. This additionally makes it possible to achieve, by straightforward measures, a configuration in the case of which the visual impression with the weighing unit installed differs only to an insignificant extent, if at all, from the visual impression with the weighing unit not installed.

If only part of the second housing part forms the mail support, then it is preferably provided that the second housing part includes a shell, which is provided for forming the mail support of the weighing unit, and at least one intermediate element, which is connected releasably to the shell and then bears second fastening devices, which are configured for interacting with the first fastening devices. If the weighing unit is then to be installed, all that is required is for the second housing part to be removed from the first housing part, the intermediate element to be removed and the shell to be positioned on the weighing unit, configured for accommodating the shell, before or after the weighing unit has been inserted into the recess.

The intermediate element is then, furthermore, preferably configured such that it extends over that border region of the second housing part which is adjacent to the first housing part, with the result that its removal produces a sufficiently large gap between the first housing part and the shell positioned on the installed weighing unit, this gap ensuring that the mail support does not come into contact with the first housing part during operation, which would otherwise result in errors in the measuring result.

It is preferably provided that electrical connecting devices for connecting the weighing unit are provided in the region of the recess, with the result that the weighing unit can be retrofitted particularly straightforwardly and quickly.

It is preferable for the franking machine already to have been provided with a weighing unit provided in the recess, in the case of which, further preferably, the mail support is formed by at least part of the second housing part.

With the objects of the invention in view there is also provided, a franking machine, including:

a housing including a first housing part;

the first housing part having a recess formed therein, the recess being configured such that a retrofittable weighing unit can be inserted therein; and first fastening devices disposed at the recess; and a second housing part closing the recess, the second housing part being fastened releasably on the first housing part via the first fastening devices.

With the objects of the invention in view there is also provided, a franking machine, including:

a housing including at least a first housing part;

the first housing part having a recess formed therein;

a retrofittable weighing unit disposed in the recess; and first fastening devices disposed at the recess and configured such that a second housing part can be fastened for closing the recess.

Other features which are considered as characteristic for the invention are set forth in the appended claims.

Although the invention is illustrated and described herein as embodied in a franking machine having a retrofittable weighing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
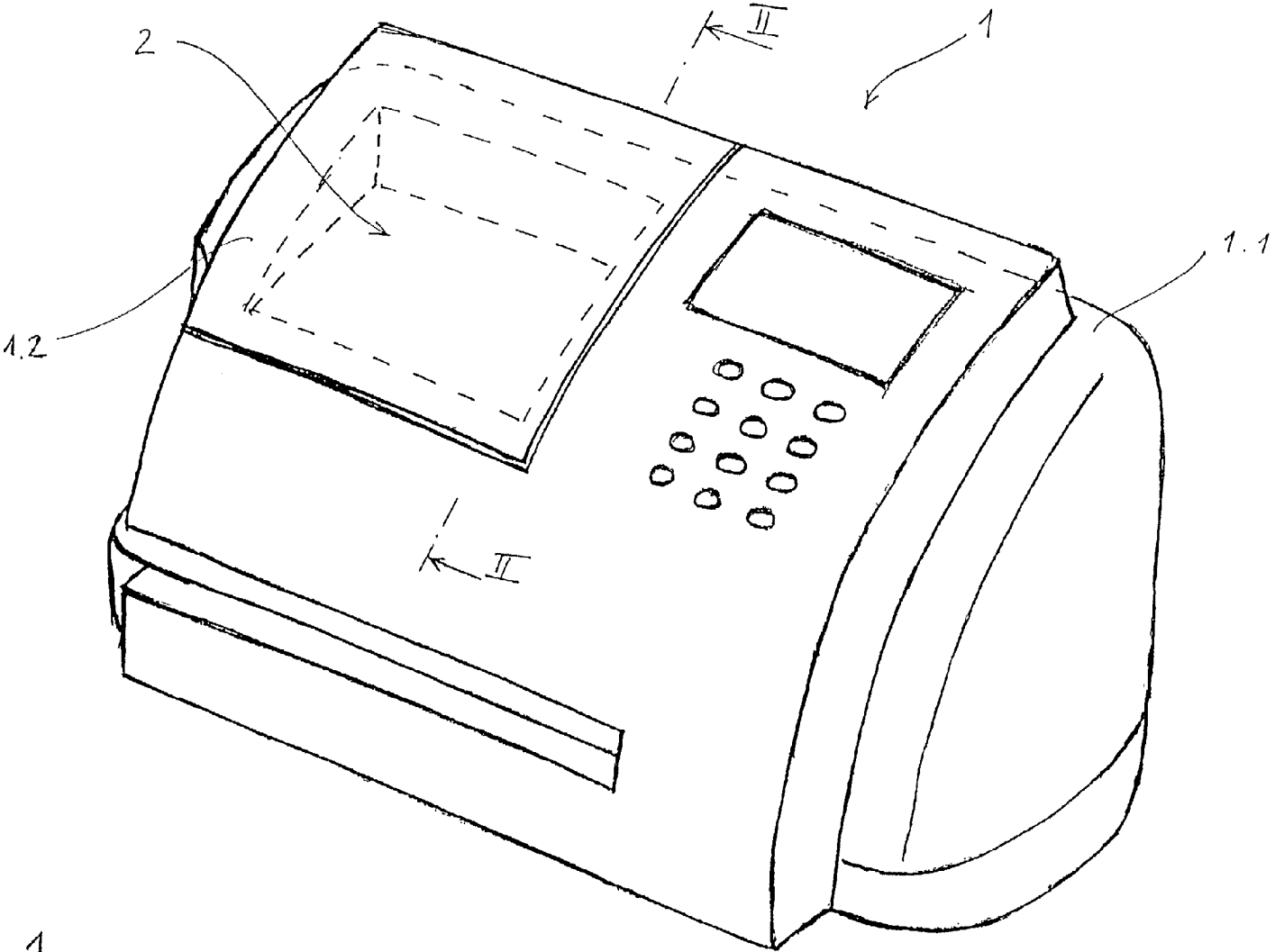
FIG. 1 is a perspective view of a preferred exemplary embodiment of the franking machine according to the invention.

Referring now to the figures of the drawings in detail and first, particularly, to FIG. 1 thereof, there is shown a perspective view of a preferred exemplary embodiment of the franking machine 1 according to the invention having a first housing part 1.1 and a second housing part 1.2, which is fastened on the first housing part and covers a recess 2 of the first housing part 1.1, the recess being provided in the top side of the franking machine 1.

Figure 2:
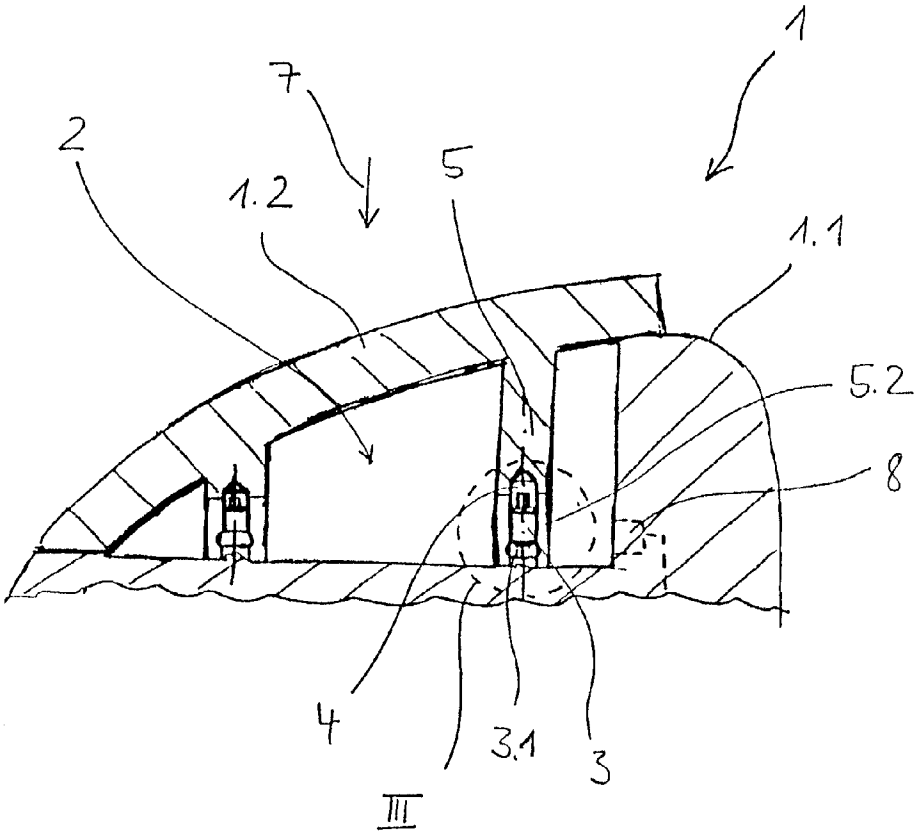
FIG. 2 is a partial sectional view along line II-II, through part of the franking machine of FIG. 1.

As can be gathered from FIG. 2, first fastening devices in the form of fastening pins 3 are provided in the region of the recess 2, the fastening pins being integrally formed on the first housing part 1.1. These fastening pins 3 are each seated in a bore 4 of a fastening arm 5 which, in turn, is integrally formed on the second housing part 1.2.

Figure 3:
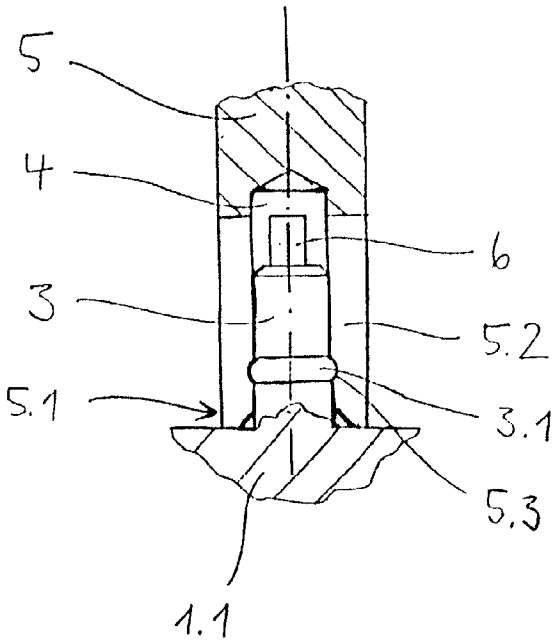
FIG. 3 is a partial sectional view of the detail III of FIG. 2.

As can be gathered from FIG. 3, the fastening arm 5 has, in the region of the bore 4, four circumferentially distributed longitudinal slits 6 which extend as far as the end 5.1 of the fastening arm, the end being directed toward the first housing part. As a result, four fastening lugs 5.2, which can move resiliently in the radial direction, are fastened at the end 5.1 of the fastening arm 5, the end being directed toward the first housing part 1.1.

Provided on the inside of the bore 4 is an encircling notch 5.3, into which an encircling, bead-like protrusion 3.1 on the fastening pin 3 is latched. This realizes a plug-in and snap-in connection which is straightforward to produce and release by the second housing part 1.2 respectively being plugged onto the first housing part 1.1 in the direction 7 and drawn off from the first housing part 1.1 counter to the direction 7.

In the present case, four fastening pins 3 provided in the corner regions of the recess are provided. It goes without saying, however, that, in the case of other variants, it is also possible to provide any other desired number of such fastening devices.

It also goes without saying that, in the case of other variants, it is also possible for the plug-in connection to be provided the other way round. It is thus also possible for the fastening pin to be provided on a corresponding fastening arm of the second housing part and for a corresponding cutout to be provided in the first housing part.

As can also be gathered from FIG. 2, a connecting device 8 is provided in the rear region of the recess 2, via which connecting device the weighing unit, which is to be inserted into the recess 2, can be connected to the processing unit (not illustrated) of the franking machine 1.

Figure 4:
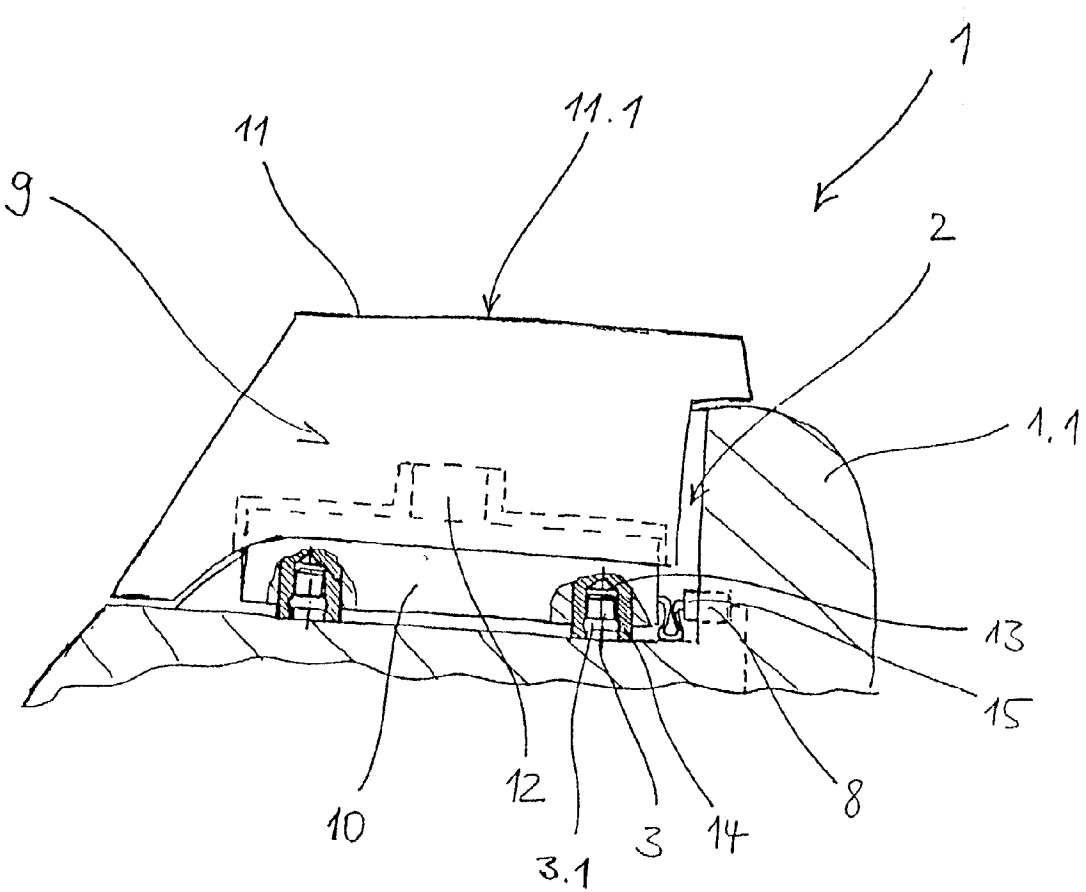
FIG. 4 is a partial sectional view of the franking machine of FIG. 1 with the weighing unit installed.

FIG. 4 shows the franking machine 1 from FIG. 2 with a weighing unit in the form of weighing scales 9 inserted into the recess 2, the weighing scales having a weighing-scales housing 10 and a covering shell 11 with a horizontal mail support 11.1. The covering shell 11 is only connected to the weighing-scales housing 10 via a load cell 12 and otherwise has no points of contact with the weighing-scales housing 10. The covering shell 11, furthermore, is provided such that it does not come into contact with the first housing part 1.1, in order to prevent the measuring results consequently being rendered erroneous.

On the underside of the weighing-scales housing 10, cutouts 13 are provided in feet 14, into which the fastening pins 3 can be introduced. The fastening pins 3 thus serve not only for fastening the second housing part 1.2 but also for fastening the weighing scales 9.

The feet 14 are formed of an elastic plastic, for example rubber, with the result that they can be elastically deformed in the region of the protrusion 3.1 of the respective fastening pin 3. The elasticity of the feet 14 here brings about a retaining force by which the weighing scales 9 are fastened on the first housing part 1.1.

A connecting plug 15 of the weighing scales 9 is plugged into the connecting device 8 in the first housing part 1.1, with the result that the weighing scales 9 are connected to the processing unit of the franking machine 1.

Figure 5:
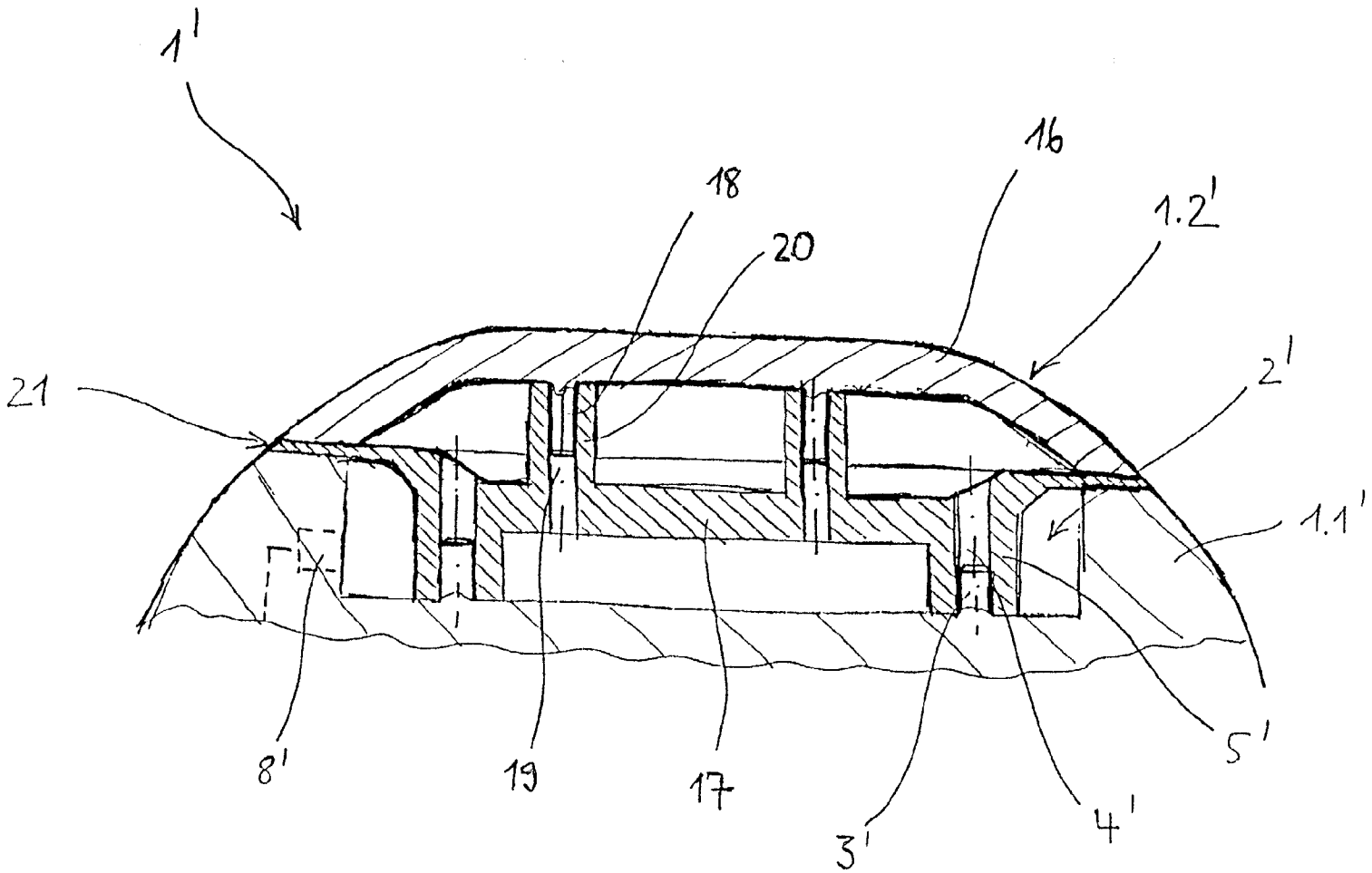
FIG. 5 is a partial sectional view of a further preferred exemplary embodiment of the franking machine according to the invention.

FIG. 5 shows a section through part of a further preferred exemplary embodiment of the franking machine 1' according to the invention which, in terms of its basic construction and functioning, is the same as that from FIGS. 1 to 4, so that only the differences will be discussed here.

One difference is that provided in the region of the recess 2' of the first housing part 1.1' are first fastening devices in the form of straightforward cylindrical fastening pins 3', which are integrally formed on the first housing part 1.1'. These fastening pins 3' are seated in a likewise cylindrical bore 4' of a fastening arm 5' which, in turn, is integrally formed on the second housing part 1.2'. The fastening pins 3' are slightly oversized in relation to bores 4' in the fastening arms 5', which have a certain degree of elasticity, with the result that a friction-fitting plug-in connection is produced.

A further difference is that the second housing part is of two-part configuration. It has a shell 16 and an intermediate element 17 which are connected releasably to one another. The releasable connection here is likewise defined as a friction-fitting plug-in connection. For this purpose, slightly oversized cylindrical connecting pins 18, which are integrally formed on the shell 16, are seated in cylindrical bores 19 in connecting arms 20 of the intermediate element 17, the arms having a certain degree of elasticity.

The intermediate element 17 extends into the gap 21 between the shell 16 and the first housing part 1.1', with the result that the shell 16 does not come into contact with the first housing part 1.1'.

As can also be gathered from FIG. 5, a connecting device 8' is provided in the region of the recess 2', via which connecting device a weighing unit, which is to be inserted into the recess 2', can be connected to the processing unit of the franking machine 1'.

Figure 6:
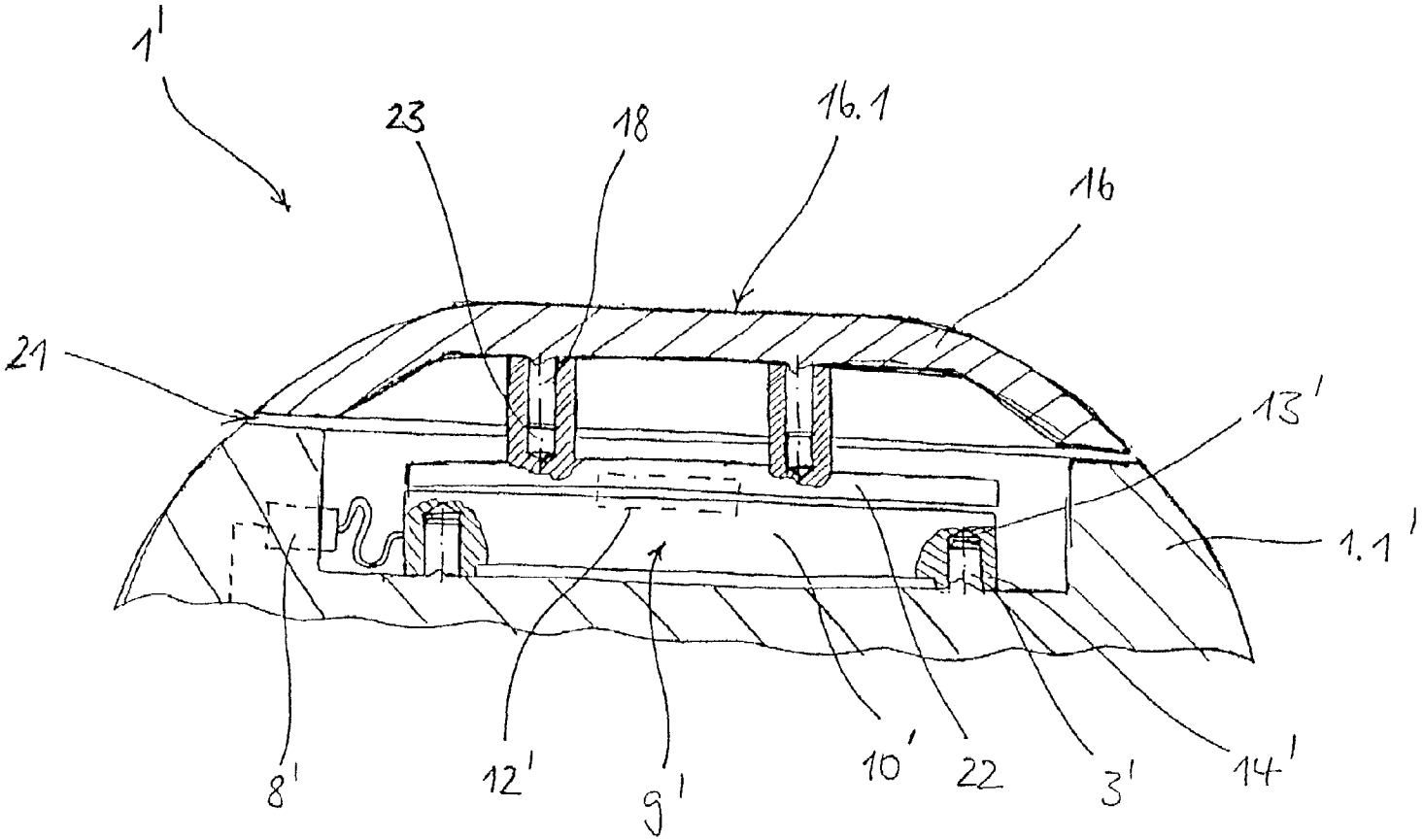
FIG. 6 is a partial sectional view of the franking machine of FIG. 5 with the weighing unit installed.

FIG. 6 shows the franking machine 1' from FIG. 5 with a weighing unit in the form of weighing scales 9' inserted into the recess 2', the weighing scales having a weighing-scales housing 10' and a covering shell, which is formed by the shell 16. The shell 16 here forms a horizontal mail support 16.1 by way of its horizontal surface.

The shell 16 is fastened on a crossmember 22, which is only connected to the weighing-scales housing 10' via a load cell 12' and otherwise has no points of contact with the weighing scales housing 10'. The shell 16 is, furthermore, provided such that it does not come into contact with the first housing part 1.1', in order to prevent the measuring results from being consequently rendered erroneous. This is brought about in a straightforward manner in that the intermediate element 17 has been removed and the gap 21 between the shell 16 and the first housing part 1.1' is now free.

The shell 16 is simply plugged, via the cylindrical connecting pins 18, into cylindrical bores 23 of the crossmember 22, which has a certain degree of elasticity. Here too, the connecting pins 18 are slightly oversized in relation to the bores 23, with the result that, here too, a friction-fitting connection is produced between the crossmember 22 and the shell 16.

On the underside of the weighing-scales housing 10', in turn, cutouts 13' are provided in feet 14', which have a certain degree of elasticity and into which the fastening pins 3' can be introduced. Here too, the fastening pins 3' are slightly oversized in relation to the cutouts 13', with the result that, here too, there is a friction-fitting connection between the weighing scales 9' and the first housing part 1.1'. It is thus also the case here that the fastening pins 3' serve not only for fastening the second housing part 1.2' but also for fastening the weighing scales 9'.

Furthermore, a connecting plug 15' of the weighing scales 9' is plugged into the connecting device 8' in the first housing part 1.1', with the result that the weighing scales 9' are connected to the processing unit of the franking machine 1'.

The invention claimed is:

1. A franking machine, comprising:

a housing including at least a housing part;

said housing part having a recess formed therein;

a retrofittable weighing unit disposed in said recess; and fastening devices disposed at said recess and configured such that a further housing part can be fastened for closing said recess;

said weighing unit having a mail support forming at least part of the further housing part.

2. The franking machine according to claim 1, wherein said recess is configured for accommodating said retrofittable weighing unit with said mail support extending substantially horizontally.

3. The franking machine according to claim 1, wherein:

said housing has a top side; and said recess is disposed on said top side of said housing.

4. The franking machine according to claim 1, wherein said fastening devices are configured for fastening said retrofittable weighing unit.

5. The franking machine according to claim 4, wherein said fastening devices are disposed on said housing part.

6. The franking machine according to claim 1, wherein said fastening devices are configured to provide at least one connection selected from the group consisting of a plug-in connection and a snap-in connection.

7. The franking machine according to claim 6, wherein said fastening devices include at least one pin-shaped fastening element.

8. The franking machine according to claim 1, including electrical connections disposed at said recess for connecting said retrofittable weighing unit.

9. A franking machine, comprising:

a housing including a first housing part;

said first housing part having a recess formed therein, said recess being configured such that a retrofittable weighing unit can be inserted therein;

fastening devices disposed at said recess; and a second housing part closing said recess, said second housing part being fastened releasably on said first housing part via said fastening devices, said second housing part having a given portion configured as a mail support for the weighing unit.

10. The franking machine according to claim 9, wherein:

said second housing part includes a shell as said mail support for the weighing unit and an intermediate element releasably connected to said shell; and said intermediate element has further fastening devices configured to interact with said fastening devices.

11. The franking machine according to claim 9, including electrical connections disposed at said recess for connecting the weighing unit.

* * * * *